US006832455B1

(12) United States Patent
Tomlinson et al.

(10) Patent No.: US 6,832,455 B1
(45) Date of Patent: Dec. 21, 2004

(54) STRUCTURE

(76) Inventors: Andrew David Tomlinson, 41 Broadway, Llanblethian, Cowbridge (GB), CF71 7EX; Martin James Tomlinson, Bryn Hyfryd, Primrose Hill, Cowbridge (GB), CF71 7DU ( * ) Notice: Subject to any disclaimer, the term of this patent is extended or adjusted under 35 U.S.C. 154(b) by 37 days.

(21) Appl. No.: 10/030,955

(22) PCT Filed: Jul. 6, 2000

(86) PCT No.: PCT/GB00/02419

§ 371 (c)(1),
(2), (4) Date: Jan. 7, 2002

(87) PCT Pub. No.: WO01/02657

PCT Pub. Date: Jan. 11, 2001

(30) Foreign Application Priority Data

| | | |
|---|---|---|
| Jul. 6, 1999 | (GB) | 9915663 |
| Oct. 7, 1999 | (GB) | 9923594 |
| Mar. 29, 2000 | (GB) | 0007556 |

(51) Int. Cl.[7] ..... E04B 1/00

(52) U.S. Cl. ..... 52/259; 52/745.07; 52/745.06; 52/82; 52/81.2; 52/90.1

(58) Field of Search ..... 52/259, 745.06, 52/745.13, 81.2, 81.3, 82, 6, 90.1, 251, 745.07, 127.2, 127.1, 745.2

(56) References Cited

U.S. PATENT DOCUMENTS

| | | | | | |
|---|---|---|---|---|---|
| 481,347 | A | * | 8/1892 | Cunningham, Jr. | 52/82 |
| 2,175,468 | A | * | 10/1939 | Jones | 52/68 |
| 2,231,396 | A | * | 2/1941 | Smits | 52/81.2 |
| 2,690,185 | A | * | 9/1954 | Pomykala | 135/137 |
| 3,427,777 | A | * | 2/1969 | Crowley | 52/745.08 |
| 3,495,365 | A | * | 2/1970 | Blaski | 52/127.1 |
| 3,828,496 | A | * | 8/1974 | Testaguzza | 52/259 |
| 3,846,953 | A | * | 11/1974 | Hodess | 52/745.08 |
| 3,894,367 | A | * | 7/1975 | Yacoboni | 52/81.2 |
| 4,068,422 | A | * | 1/1978 | Sumner | 52/81.2 |
| 4,275,534 | A | * | 6/1981 | Porter | 52/82 |
| 4,400,927 | A | * | 8/1983 | Wolde-Tinase | 52/745.08 |
| 4,720,947 | A | * | 1/1988 | Yacaboni | 52/81.3 |
| 4,805,371 | A | * | 2/1989 | De Jong et al. | 52/259 |
| 5,067,288 | A | * | 11/1991 | Takahama et al. | 52/81.2 |
| 5,274,974 | A | * | 1/1994 | Haag | 52/283 |
| 5,724,775 | A | * | 3/1998 | Zobel et al. | 52/82 |
| 5,818,990 | A | * | 10/1998 | Steijer et al. | 385/49 |
| 5,896,709 | A | * | 4/1999 | Pope | 52/90.1 |
| 5,916,097 | A | * | 6/1999 | Markuten | 52/81.2 |
| 6,243,994 | B1 | * | 6/2001 | Bernini | 52/86 |
| 6,282,842 | B1 | * | 9/2001 | Simens | 52/80.1 |
| 6,318,043 | B1 | * | 11/2001 | Johnson | 52/639 |
| 6,430,892 | B1 | * | 8/2002 | Castano | 52/745.08 |

FOREIGN PATENT DOCUMENTS

| | | |
|---|---|---|
| DE | 31 37 202 A1 | 5/1983 |
| EP | 0777019 A1 | 6/1997 |
| FR | 910444 | 6/1946 |

* cited by examiner

*Primary Examiner*—Carl D. Friedman
*Assistant Examiner*—Nahid Amiri
(74) *Attorney, Agent, or Firm*—Edwin D. Schindler

(57) ABSTRACT

A method for fabricating a space frame structure, such as a dome, for covering an open space, with the space frame structure being assembled from beam members, which intersect at rigid mode joints. The beam members and other structural components used in the skeleton of the space frame are made from pre-cast concrete, which has not been subjected to pre-tensioning and the rigid node joints are formed in situ, for example, by casting concrete joints incorporating the ends of the beam members. The loads imposed by the weight of the beam members on the beams and the node joints effectively simulate pre-stressing of the components which act within the assembled structure as pre-stressed concrete.

35 Claims, 12 Drawing Sheets

STRUCTURE

The present invention relates to a structure, notably to a system of concrete beams for forming a dome-like structure.

BACKGROUND TO THE INVENTION:

This invention relates to skeletal frame systems which support fibreglass or other flexible, semi-rigid or rigid roofing sheets, panels or glazing to provide a weatherproof or other cover or roof over large open spaces. Typical examples of where such systems find use are sports fields, stadia, velodromes, athletic tracks, assembly buildings, stockpile covers, leisure facilities, aircraft hangers, open plan factories, train or bus stations, vehicle garages or stores and the like. For convenience, such potential uses for the systems will be denoted herein in general by the term covered open spaces.

Such systems usually require that the roof structure should not be supported by internal pillars, since these would interfere with the free use of the internal space of the covered open space and, in some cases, would obstruct the view of spectators.

Large span structures, that is structures which have a clear span length of 50 meters or more, have traditionally been constructed using steel as the structural material. Large span steel structures which are substantially planar require out of plane strutting to provide stability and to enable the structure to be self-supporting and to carry its design load. This can result in a mass of secondary steelwork, which is not only expensive, but is also visually unattractive. The present invention relates to the construction of three-dimensional structures, for example domes and the like, where the roof structure extends in three dimensions over an open space. Such structures comprising discrete members rigidly joined together are commonly known as space frames. Typically, the radially outward periphery of the frame subtends an angle of 10° or more (preferably, 10° to 30°) to the horizontal. However, such frames may progressively flatten towards their apex so that the angle subtended to the horizontal decreases, often to zero or near zero at the apex of the frame.

A space frame is a structure in which a plurality of individual components are linked together via rigid joints to form the overall structure. For convenience, the term node joint will be used herein to denote one of the points within the overall structure at which a plurality of the components, for example tubes, rods, bars or beams, are interconnected or jointed together to form the structural framework of the space frame. The node joints are substantially rigid so that they can transmit moments from one component of the structure to another. A space frame is typically a three dimensional structure.

A typical form of such a space frame comprises steel bars having screw threaded ends, which are interconnected at the node joints by means of machined steel blocks with threaded holes into which the threaded ends of the bars engage. It will be appreciated that by their very nature the bars and blocks have to be made to close tolerances. Furthermore, in order to minimise sagging of the metal bars and to keep their transverse thickness within acceptable limits, the bars have to be comparatively short. This requires the use of a large number of joints to achieve a large span structure. This makes such structures complex and expensive.

Another form of a space frame uses tubular steel members welded together at the node joints. The individual tubular members are usually cut from lengths of tube and require the formation of complex shapes at the ends thereof to provide a good fit of the components upon one another at the node joints where typically three, four or more tubular members engage one another. Whilst such members and the node joints could be manufactured off site, it is usually necessary to finalise the exact shape and dimensions of the ends of the tubular members on site as construction of the space frame proceeds. In addition, the individual components have to be assembled into the space frame on site, which requires the use of high towers to support the assembled components in position and subsequent welding of the components at each node joint to form the overall structure. This is complex, costly and often hazardous for the construction operatives.

A fundamental characteristic of a space frame is that all joints at the nodes have to be rigid in the structural sense, i.e. capable of transmitting moments and shears in the X, Y and Z axes and to resist twisting about any of these axes. Traditional designs of such structures using conventional fabrication methods can only achieve this three-dimensional rigidity with cumbersome and expensive joints. Welding of tubular components, or threading of solid bars into solid jointing blocks does achieve this rigidity, but only at a high cost and using complex fabrication techniques.

In steel space frames the dominant cost element will be the joints, whether welded tubular joints or machined and screw threaded blocks. However, reducing the number of joints by increasing the length of the individual bar or beam members is often not possible since the compressive stresses which may be permitted in steel drop off rapidly as the members increase in length, due to buckling considerations. This limits the maximum length of the members which can be used in any given case and the number of joints which can be omitted is thus limited.

Concrete is known and used as a structural material. However, concrete which has not been pre-stressed has, even with reinforcement, hitherto been considered suitable only for short span beams and to be too heavy and weak for large span structures. Established engineering practices have limited the use of concrete in long span structures to the use of pre-stressed concrete. However, where the tensioning wires or rods in a pre-stressed concrete beam or other member are tensioned after the member has been cast, problems are encountered due to in situ corrosion of the wires or rods leading to structural failure of the components. Such materials are not advocated for use in structures which are to be exposed to the elements and where a long operating life is required. Where the tensioning is introduced into the rods or wires before they are incorporated into the concrete during casting of the concrete component, the problem of corrosion is not evidenced. However, the cost of fabrication of such components becomes excessive for large and one-off components and it is impractical to fabricate large pre-stressed components on site without expert operators and complex equipment. Furthermore, difficulties and excessive costs may arise in transporting large pre-stressed concrete components from the site of manufacture to the site of use. Accordingly, pre-stressed concrete is not considered a viable material for use in fabricating a large span space frame.

The use of steel as the material from which large span space frame structures are built is currently accepted as the only practical alternative. This is despite the limitations on the length of the individual components, the complexity of the jointing techniques required to achieve three dimensional rigidity and need to maintain the structure against rust, for example by painting the exposed steel work. This often requires that the covered open space enclosed by the space frame structure be taken out of use during the painting operation.

There thus exists a need for a structurally and commercially viable alternative to the use of steel to construct large span space frames.

The major loading on individual components in a large span space frame structure, especially one made from concrete, is a dead load due to the weight of the components. We have found that, in a three dimensional structure such as a dome, this load is converted to high axial forces within the beam members of the space frame structure. We have found that these forces can be used to advantage in a large span structure to act upon concrete beams which have not been pre-stressed and to simulate the effect of pre-stressing the concrete beams. This discovery enables a conventional cast concrete or reinforced concrete beam to be used in a space frame construction. Such a material offers the designer advantages of cost savings and flexibility in design. For the constructor, the use of pre-cast concrete permits components to be manufactured to more relaxed tolerances than steel components and for the tolerances to be accommodated in node joints which are formed in situ. The use of concrete components which have not been pre-stressed enables the constructor to use simple conventional concrete casting techniques to make the beams and other components of the space frame structure on site and the ability to form the rigid node joints in situ. This allows the constructor flexibility in accommodating variations in the length of the beams and in the geometry of the structure during fabrication of the space frame structure.

SUMMARY OF THE INVENTION

Accordingly, the present invention provides a three dimensional space frame structure comprising a plurality of beam members inter-connected at rigid node joints and having a clear span of 50 meters or more, characterised in that:

a. at least some of the individual beam members of the structure are formed from pre-cast concrete which has not been pre-stressed; and b. the node joints- between the concrete beam members are substantially fully rigid in all three axes.

Broadly, the method of the present invention comprises the steps of lifting a first plurality of pre-cast concrete beam members into radially extending positions and temporarily supporting them in those positions, lifting a second plurality of pre-cast concrete beam members into circumferentially extending positions spanning said radially extending beams and temporarily supporting them in those positions.

Preferably, the structure comprises a series of individual pre-cast concrete beam members extending generally radially from a central hub or apex and interconnecting with one or more, preferably generally concentric, rings formed from pre-cast concrete beams extending generally circumferentially, the radial and circumferential beams being connected to one another at rigid node joints whereby the jointing between the beams provides a structure which is substantially rigid in three dimensions. Preferably, the node joints are formed by casting concrete joints between the beams in situ in the assembled structure.

In a particularly preferred aspect, the invention provides a space frame structure comprising a plurality of pre-cast concrete first axially elongated beam members jointed together in a radial arrangement when viewed in plan view, at least some of the first beam members being jointed to one or more rings of circumferentially extending pre-cast concrete second axially elongated beam members by joint members, the first members being angled to the horizontal at at least the radially outward periphery of the structure, and the joint members being substantially rigid joints between the members.

In such a structure, the second beam members act as partial supports for the first beam members and thus reduce the bending moments and deflections along the length of the first beam members. The rigid joint members enable the full bending strength of all the intersecting members, that is major axis bending, minor axis bending and torsion, to be mobilised at the joints, thereby providing enhanced stability against buckling due to changes in geometry of the structure under load.

The invention also provides a method for fabricating a large span space frame structure, which method comprises supporting a plurality of pre-cast concrete beam members in the desired location and orientation to form the structural elements of the space frame and securing the beam members to one another by rigid joints.

Preferably, the beam members converge at node points and rigid node joints are formed at the node points by incorporating the ends of the beam members at the node point in a rigid joint which is cast in situ.

In a particularly preferred embodiment of the method of the invention the components of the space frame structure are assembled in the desired location and orientation upon temporary support members and the rigid node joints are cast in situ and allowed to cure to form a rigid self-supporting space frame structure and the temporary support members are progressively removed.

The invention can be applied to the construction of structures of a wide range of shapes, for example domes which have a square, rectangular, circular, oval or elliptical plan shape and which have a curved or polygonal vertical cross section in which the angle the beam members subtend to the horizontal can be from 10 to 30° and may vary from such an angle at the radially outward periphery of the structure to a value of zero or near zero at the apex of the structure. The structure may converge at its apex to a single hub or point or to an annular ridge member; or may converge to a generally horizontal or bowed linear ridge, for example in the case of a structure having an oval plan shape.

The structures may also comprise secondary structural members which extend between the radial and/or circumferential main beam members, such as Z purlins, struts and cross beams, which may be used to impart added rigidity to the structure. The term beam will therefore be used herein to denote in general all such axially extended components, whether they provide the main radial or circumferential members of the structure or are secondary members.

As indicated above, the invention is especially applicable to large span structures, that is structures which have a clear unsupported span of at least 50 meters, typically 75 to 175 meters or more. The number of radial beams in such a structure may vary with its size and, in general, the larger the span, the greater the number of radial beams which are required to form a rigid structure without excessive circumferential spans between adjacent radial beams. If desired, a single radial beam may bifurcate at a node joint to provide two or more radial beams extending radially outward from the node joint to reduce the span between adjacent radial beams radially outwardly from that node joint. In plan view, the included angle between the circumferential beams at a given node joint will depend upon the number of radial beams radiating from the central hub or apex of the structure. We have found that this included angle should in general be less than 160°. It is particularly preferred that there should be less than 16, typically 4 to 14, notably 6 to 12, radial beams radiating from the central hub or apex of the structure and from 1 to 5 rings of circumferential beams intersecting those radial beams; and that the plan angle included between the circumferential beams at the node joints is from 90 to 150°, notably 110 to 150°. Where the structures contain nearly straight portions, as with elliptical or oval plan shape structures, the included angles at the node joints in such portions may be nearer, but less than, 180°. However, the majority of the node joints in such structures will be less than 150° and may be as low as 90° in the case of square or rectangular plan shape structures.

The structures are not truly circular in plan shape where the beam members are straight beams. The terms concentric and circumferential as used herein are therefore to be construed as including not only structures having a circular plan shape, but structures which have a polygonal plan shape, including square or rectangular plan shapes.

The structure may rest directly upon foundations at ground level or may be supported above ground level by piers, buttresses, walls or other structures which support the radially outward portions of the radial beams above ground level. Such supports can be of conventional design and construction and can be vertical or inclined radially inwardly or outwardly.

For convenience, the invention will be described in terms of a dome structure having a generally circular plan shape and converging to a central solid or annular hub, with the curvature of the surface of the dome decreasing from an angle of from 15 to 20° to the horizontal at its outer periphery to about zero degrees at the hub, and with an included angle between the circumferential beams at a node joint of about 120°.

The concrete beam members may be of any suitable dimensions, for example exceeding 40 meters in length, and may be either cast on site or cast elsewhere and delivered to the site of the structure for assembly on site. The term pre-cast is therefore used herein to denote that the concrete member is formed before it is incorporated into the structure as opposed to being cast in situ. As stated above, the concrete members, notably the beam members, are not pre-stressed, that is the members do not contain rods, bars, cables or other tensioning members which have been tensioned before or after the casting of the concrete members to apply significant axial compressive stresses to the components before they are incorporated into the space frame structure.

The individual members of the skeleton of the space frame may be formed either as solid concrete and/or reinforced beams or other members. However, the beams may be cast as hollow members, for example hollow box or tubular beams, using conventional techniques. The use of hollow beams is preferred for longer spans, since this provides a beam having a greater stiffness for a given weight than a solid beam. The use of hollow beams also enables the designer of the structure to locate wiring and service ducts, for example drainage or ventilation ducts or access walkways, within the beams and thus improve the visual and safety aspects of the structure. If desired, one or more reinforcement materials, for example steel rods or mesh, or carbon, glass or polymer fibres, or woven, non-woven or reticulate materials can be incorporated into the concrete member. Whilst such reinforcement may be subjected to tensioning if desired to ensure that it is uniformly deployed within the concrete as it is cast, such tensioning is not sufficient to introduce significant axial compressive forces into the concrete component containing it so that the component is substantially non-pre-stressed when it is incorporated into the space frame structure.

The individual beam members may be of constant cross section along their length, or may be tapered both in width or depth or both. Alternatively, they may have a curved surface in cross section. The individual members may be straight or curved along their length. As described below, individual short beam members can be jointed together to form longer beam members using the rigid jointing techniques described below to form a longer unitary beam member to aid transport, storage and handling of the shorter beam members.

The terminal portions of the beam members are linked to one another to form the desired rigid joint at each nodal joint. The terminal portions of the beams can thus engage with a metal jointing spider of suitable configuration to form a temporary mechanical joint which is then made permanent and rigid by casting concrete around the joint in situ. The jointing spider can take a wide range of forms, for example metal fish plates or other connectors extending radially from a suitable hub to which the ends of the beams are bolted. Alternatively, the ends of the beams at a node joint can be provided with axially extending plates, bars or other members, for example the projecting terminal portions of reinforcing rods within the concrete of the beam, which inter-engage with or oppose to those on the ends of other beam members at the node joint to form a lapped structure which can be imbedded in concrete to form a permanent rigid joint. If desired, some of the inter-engaging rods can be screw threaded and engage suitable sockets carried by a central spider or hub or by other beam members to form a temporary mechanical joint to support the beam ends at the node joint until the permanent joint is formed. If desired, hoops, U bars, mesh or other reinforcement can be wound around or incorporated into this structure prior to formation of the permanent joint.

In a further alternative, the spider may take the form of a series of radial sockets carried by a central hub, into which the ends of the beam members and/or the axially extending rods engage. If desired, the sockets can be a tight fit upon the ends of the beams and can be provided with screw or other means for drawing the ends of the beams into the sockets to the desired extent to accommodate manufacturing variations in the length of the beam members. Alternatively, the sockets can be provided with clamping means for tightening the socket upon the end of the beam, once the end of the beam has been engaged into the socket to the desired extent.

For convenience, the term temporary mechanical joint will be used herein to denote all such forms of temporary joint which are then incorporated into the permanent rigid node joint.

The spider or other mechanical joint can enclose the node joint so that it provides part or all of the shuttering for containing the fluid or semi-fluid concrete as the permanent joint is formed. Alternatively, conventional wooden or plastic shuttering boards, troughs or channels can be provided around the node joint to retain the concrete and then removed once the joint has set.

At the apex of the construction, the ends of the beams can engage one another as described above to form a node joint at the apex. Alternatively, the apex is provided with a discrete hub member to which the ends of the beam members are jointed to form the apex of the space frame structure. The ends of the beams engaging the solid or annular hub at the apex of the structure can be jointed to the hub in a similar manner to that described above for forming the node joints between the beam members. The hub may be formed as a solid or hollow disc or the like, or as a pre-cast ring member. Alternatively, the hub may be formed in situ from a series of short radial and annular beam members. The hub may have a central aperture, for example to provide ventilation to the enclosed open space within the dome; or the aperture can be closed by one or more transverse walls or diaphragms as they are known in the construction industry which transmit radial forces diametrically across the disc or ring of the hub. The radially outward face of the hub may incorporate a radial flange or a series of radial sockets or other means upon or into which the ends of the radial beams members engage to provide temporary support for the radial beams until the rigid joint between the beams and the hub can be formed. If desired, bolts or other means can be provided to secure the ends of the beam member to the hub and to provide a measure of radial adjustment to the position of the beams to accommodate variations in the length of the beams and the wall thickness of the hub member.

The hub, the ends of the radial and circumferential beams intersecting at a node joint and any associated temporary mechanical joint are supported in the desired configuration by a temporary structure, for example a scaffolding or other tower of any suitable design and construction. This enables the node joints and the remainder of the space frame structure to be assembled and supported in the assembled configuration. The shuttering or other means for retaining the concrete in place around the joints during setting of the concrete can also be supported in position by these temporary support structures. The temporary support structures can then be progressively removed once all the permanent joints have cured sufficiently for the space frame structure to become rigid and self-supporting.

The material used to form the in-situ cast joint at the node and other joints may have a cementitious base, be concrete, an epoxy resin or other chemical bonding compound. For convenience, the invention will be described hereinafter in terms of the use of concrete for the in-situ cast joint. The joint can incorporate fibre, rod or other reinforcement, for example the materials used to form the temporary mechanical joint between the intersecting members at the node. The joint can be formed by any suitable technique, for example by pouring, injecting, spraying, ramming, packing, trowelling the fluid or semi-fluid concrete mixture into the spaces in the joint structure to encase the temporary mechanical joint and the ends of the beams members and finishing off the exposed surfaces of the joint with a trowel or other smoothing device.

It will be appreciated that by forming the rigid joint in situ as the structure is assembled, variation in the dimensions of the individual members, notably their length, can be accommodated to a greater extent than with a fabricated steel space frame. However, this relaxed tolerance in dimensions means that secondary members to be attached at specific points to the main beams, such as Z purlins, which are usually prefabricated to exact dimensions, may require modification on site, for example by drilling holes in the secondary beams, to fit to mountings provided at desired locations on the main beams.

However, drilling the fixing holes on site is time consuming. Whilst the fixing holes in the ends of the secondary beams and/or the mounting brackets carried by the main beams could be elongated into slots so as to accommodate variations in the length of the main beam members, this may not provide a sufficiently rigid connection between the main and secondary beam members for many conditions. We have devised an alternative means for accommodating variations in the length of the main beam members which uses a screw, cam or other mechanism engaging a fixed anchorage point on the main or secondary beam and which adjustably moves a mounting bracket into register with mounting bolts or holes in the end of the beam to be secured to that mounting. Typically, the main beams carry transversely extending bolts, studs or the like cast into the concrete of the main beam at the locations where the secondary beam is to be attached. The mounting bracket is preferably L shaped and is provided with a slot in one arm of the L into which two of those bolts or studs engage to permit the bracket to move axially and/or transversely upon the main beam. The bracket is provided with two opposed eye bolts, whose eyes engage with the shanks of the bolts or studs of the main beam protruding through the slot in the bracket. The positions of the two eyes with respect to the slot can be adjusted by nuts, screw, cam or other mechanisms. The position of the bracket upon the main beam member can be adjusted by slackening off one eye bolt and tightening the other so that the bracket moves axially with respect to the bolts extending through the slot. By tightening both eye bolts axially outward with respect to the slot, the eyes will secure the mounting bracket firmly upon the main beam at the desired position. In this way the position of the bracket can be adjusted to accommodate variations in the dimensions of the main beam without the need to modify the secondary beam. It will be appreciated that the adjustable mounting bracket can be carried by the secondary beam rather than by the main beam.

If desired, during the fabrication of the temporary joints at the node joints or the secondary beams, a rapid setting resin can be injected into the joint to form an initial joint which is sufficiently strong to hold the members in the desired positions whilst shuttering is constructed around the joint and concrete poured into the shuttered space to form the permanent rigid joint in situ. If desired, at least part of the work in forming the joint can be carried out from within the beam member where this is a hollow beam.

Where the beam member is a hollow beam, the rods, etc extending axially from the end thereof will usually be around the periphery of the beam. It may be desirable to form an internal transverse wall or diaphragm at or adjacent the open end of the beam so as to provide a mechanical link to the annular joint formed when concrete is poured into the interstices between the inter-engaging rods or the like. This link transfers loads from the beam ends through the joint to other beam members incorporated into the node joint. This wall can be provided with one or more access openings for services and men into the main body of the beam. The diaphragm wall can be provided with radially extending rods or the like to inter-engage with the rods etc extending from the ends of other beams or the joint member to provide further reinforcement and inter-linking of the beam members and the jointing material of the permanent joint.

For longer spans, the length and weight of a single beam required to span a node to node distance may be excessive for ease of fabrication on site or transportation from a remote manufacturing location. It is within the scope of the present invention to form such long members in two or more sections which are jointed together as described above on the ground on site or in situ during the erection of the space frame structure to provide a unitary longer beam member.

It will be appreciated that accurate alignment vertically, horizontally and rotationally of the sections used to form such a longer member is important and we have devised a method by which a high level of alignment accuracy can be achieved. In this method, each section of the overall member is supported on two supports, located in the length of the beam near to the lifting points of the individual beam members. Each support has a PTFE or other low friction surface and has previously been levelled up using shims, screw adjusters of other means. Each support is provided with a screw or other mechanism for moving the member sideways relative to the support, whereby the sections of the overall member are manoeuvred into straight-line alignment with one another. The sections are linked to one another by a push/pull system, for example a screw, cam or other mechanism, which adjusts the gap between adjacent sections to achieve the desired axial dimension for the overall unitary beam member. The sections can then be permanently jointed together using the techniques described above. This procedure achieves correct alignment of the individual sections within the overall unitary beam member.

The formation of a unitary beam member from individual shorter beam members achieves a precise length foro the overall jointed member, since the unitary member can be assembled after the initial shrinkage of the individual beam sections as they dry out and cure h as taken place. This overcomes the problem of estimating the shrinkage which may take place when the overall beam is cast as a single component.

Whilst the invention has been described above in terms of nodes at which a plurality of individual beams are jointed to one another, it will be appreciated that radial beams need not be jointed at the node where they extend in a straight line to either side of the node, but that a single beam passing through the node may be employed. We have found that this has the effect of supporting a long beam at the no de intermediate its ends and thus of reducing the bending of the beams and of reducing the flexing and distortion of the beam under load to that which would be achieved using two shorter beams. However, the use of a long beam assists accurate alignment of the beam between adjacent concentric portions of the structure.

As stated above, the beam members can be hollow, and the use of hollow members provides a number of benefits. Thus, the interior of the beam can be used to house service or ventilation ducts. The wall of the duct effectively acts as a sound insulation to reduce the noise of ventilation equipment. This enables higher ventilation air velocities to be used without the production of unacceptable noise levels within the enclosed open space of the dome or other structure. The walls of the beam can be provided with air inlets and/or outlets to the hollow duct within, thus allowing the designer greater flexibility in optimising ventilation within the dome. The hollow beams can also be used to provide the necessary ducting for smoke extraction systems. Since the walls of the beams are made from concrete, the beams are substantially fireproof and superior to the metal ducts used in prior structures.

A hollow beam can also serve as a walkway or other pathway to permit access to the structure for repair or maintenance without the need to provide external ladders or scaffolding or to take any part of the enclosed space out of use. Furthermore, access doors or hatches can be provided in the top or side walls of the beam members to enable access to the exterior of the structure without the need for external ladders or scaffolding, thus providing a more safe and secure access to the roof cladding for service and repair. As indicated above, it will usually be necessary to provide access openings and/or doorways or hatches in any transverse diaphragm walls at the ends of the beam members.

It will be appreciated that the walls of the beam members are under stress. It will therefore be preferred to ensure that any openings formed in the outer or internal walls of the beams are provided with some form of lining to carry the stress around the periphery of the opening; and that any corners in the openings are rounded to minimise the generation of stress relief cracks within the wall of the beam. Thus, it will usually be desired to provide a substantial steel band lining to any opening in a wall of a beam member and to anchor the band into the surrounding concrete of the beam wall, typically with shear studs, the studs being welded to the band using conventional techniques.

Enclosing the services within the hollow beam members also has the advantage that the services may be fitted at an earlier stage in the construction of the structure than where the services are to be fitted externally. Normally, fitting of the services cannot commence until the dome structure is clad and weatherproof. Using the hollow beam members, service fit out can commence on completion of the structure or even earlier. For example, the hollow beam members can be fitted out with suitable service ducts and wiring or other facilities prior to being incorporated into the structure. This has major cost and time saving implications.

Where visual appearance is of minor importance, the permanent joints between the beam and other members can remain exposed. However, in some cases it may be desired to mask the joints. This can be done by decorating the joints in with the remainder of the structure. However, this may not be practical for many structures and it may be desirable to form the end of the beam with an axial extension sleeve which extends as a shroud over the exposed rods, etc which are to form part of the node or other joint. This shroud can form the external shuttering for the concrete joint to be cast in situ and any axial gap between the shroud of one beam and those of adjacent beams or other components can be in-filled with a suitably coloured mastic, cement or other filler material. Such masked joints are denoted as blind joints herein.

The invention has been described above in terms of forming the node joint in situ, optionally using temporary mechanical supports such as the spider forming an integral part of the joint. However, it is within the scope of the present invention to pre-form part of the node joint and to incorporate that into the overall joint by casting concrete in situ at the junction between the pre-formed joint component and the ends of the beam members. The use of a pre-formed node joint is of especial benefit where the beams are hollow and the node joint is complex. The pre-formed joint can be made from any suitable material, for example concrete, steel, glass or other fibre reinforced plastic or concrete, and can incorporate the transverse walls described above for the ends of the beam members.

Where a pre-formed node joint is used, it may be desirable to provide linkage members, for example screw threaded bolts or the like which can be secured into sockets in the faces of the node joint or engage in suitable sockets in the opposing end faces of the beam members. In place of screw threaded bars, plain profile bars may be used and those welded to the opposing bars of the beam members. The pre-formed node joint may be configured to provide the shuttering necessary for casting the concrete in situ to form the rigid joint. Alternatively, the pre-formed joint can provide the temporary mechanical linkage described above, and separate shuttering used in the formation of the permanent rigid joint incorporating the pre-formed jointing member.

The space frame structure of the invention serves to support any suitable roofing, glazing, netting or other cladding to provide an appropriate enclosure for the covered clear space within the structure. Thus, panels or sheets of clear or opaque material can be secured by any suitable technique to the beams of the structure either directly or indirectly.

DESCRIPTION OF THE DRAWINGS:

The invention will now be described by way of illustration to the preferred embodiments thereof as shown in the accompanying diagrammatic drawings in which.

DESCRIPTION OF THE PREFERRED EMBODIMENTS

Figure 1A:
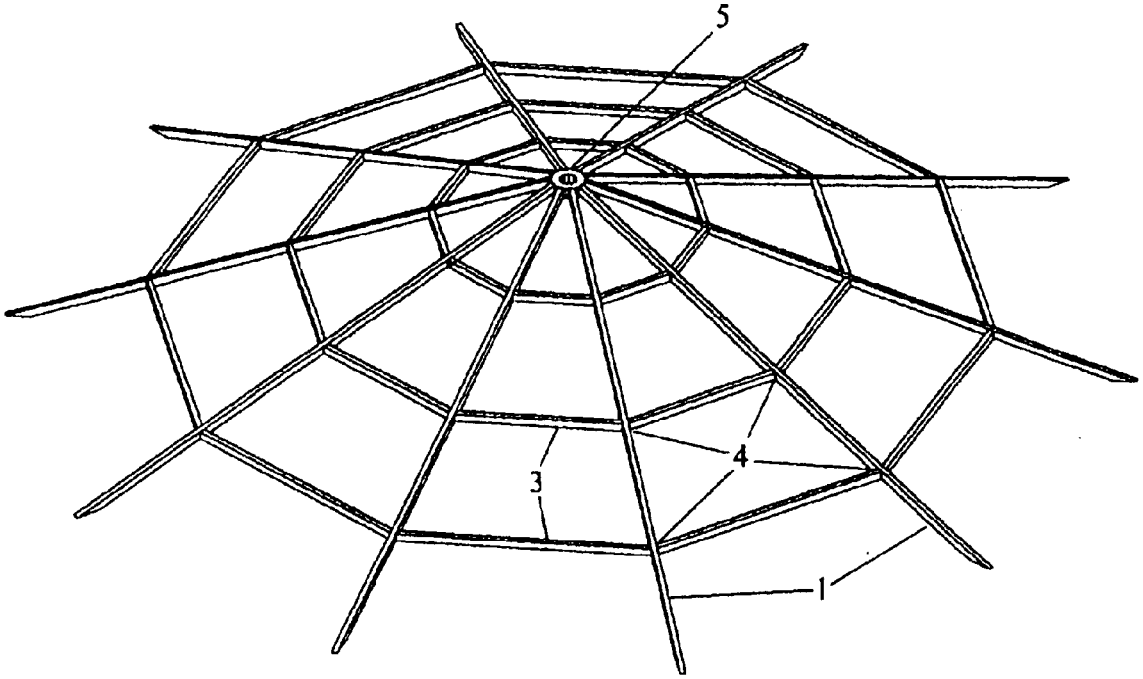
FIGS. 1*a* to 1*e* show different geometrical shapes of space frame structures which may be achieved using the present invention.
Figure 1B:
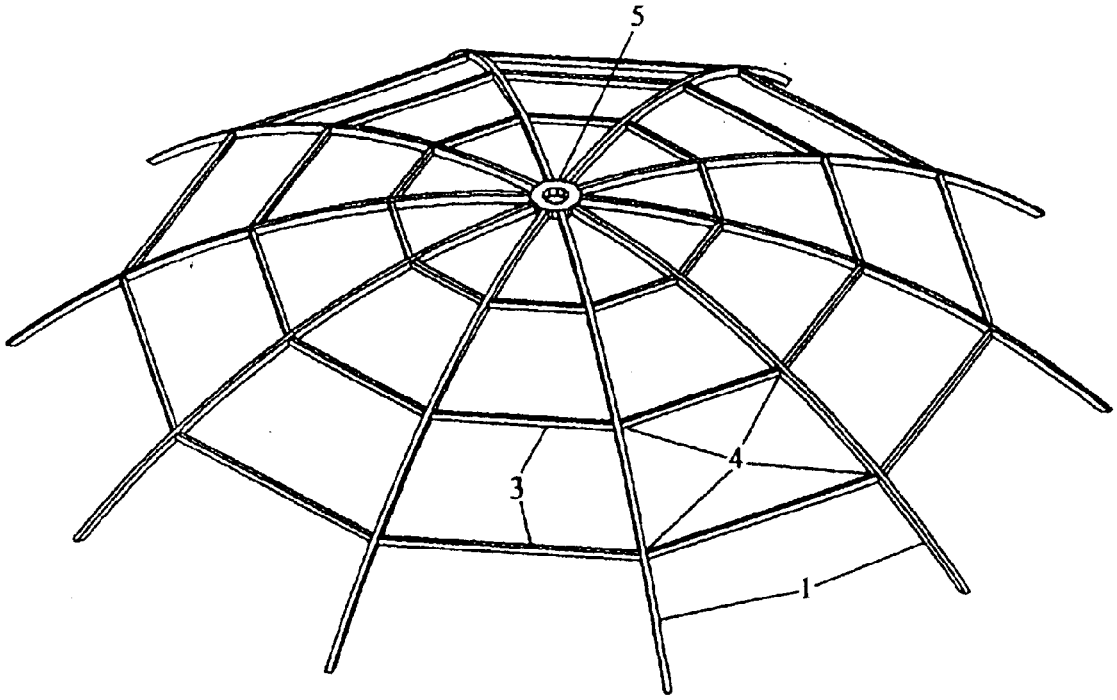
Figure 1C:
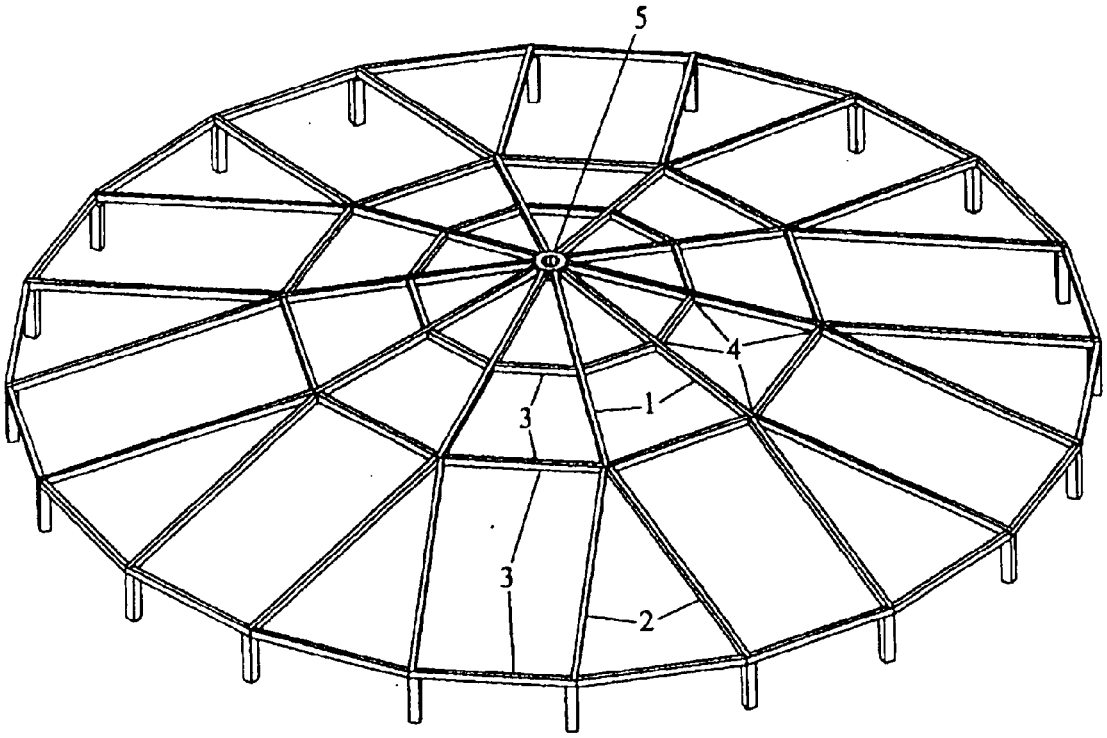
Figure 1D:
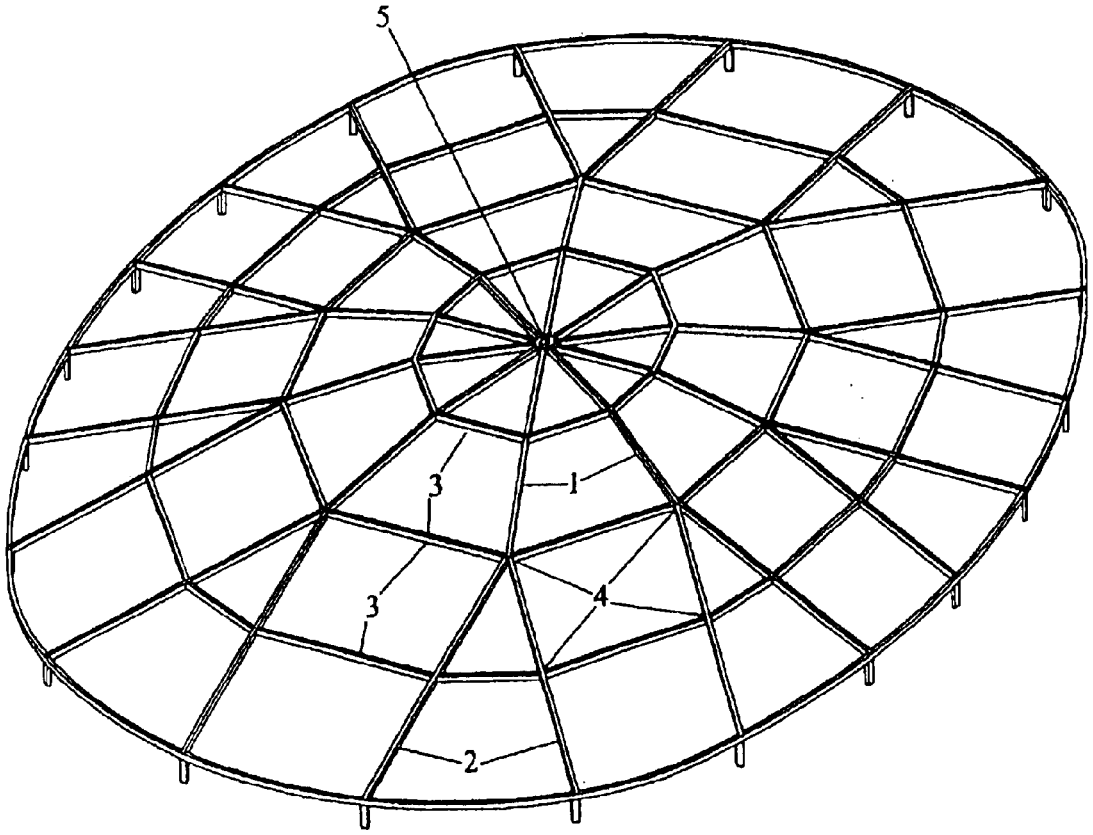
Figure 1E:
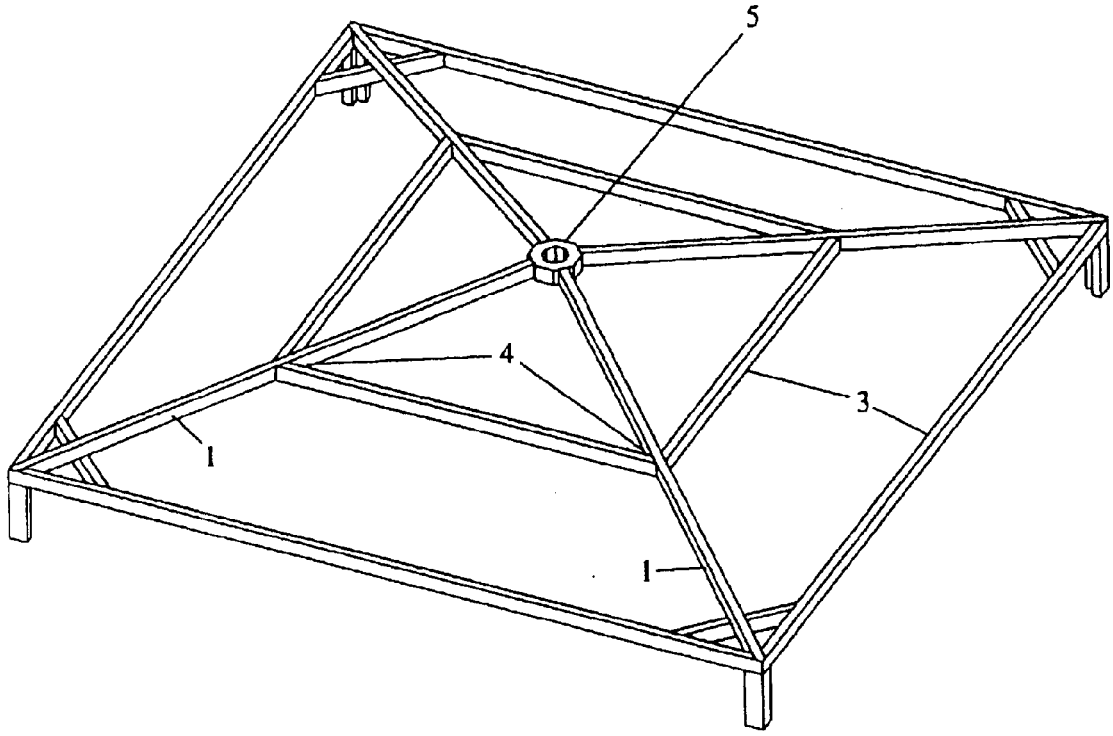

The space frame structures of the invention can take a number of forms as shown in FIGS. 1*a* to 1*e*. The forms can be simple radial faceted cones as shown in FIG. 1*a* or curved roof domes as shown in FIG. 1*b* in which the feet of the radial beams are anchored directly into the ground. Alternatively, the feet of the radial beams can be supported above ground by legs or feet as shown in FIG. 1*c*, which Figure also shows the bifurcation of the radial beams outwardly of a node point. Instead of the generally circular plan shapes shown in FIGS. 1*a* to 1*c*, the structure can have an oval plan shape as shown in FIG. 1*d* or the squared plan shape as shown in FIG. 1*e*.

Figure 2:
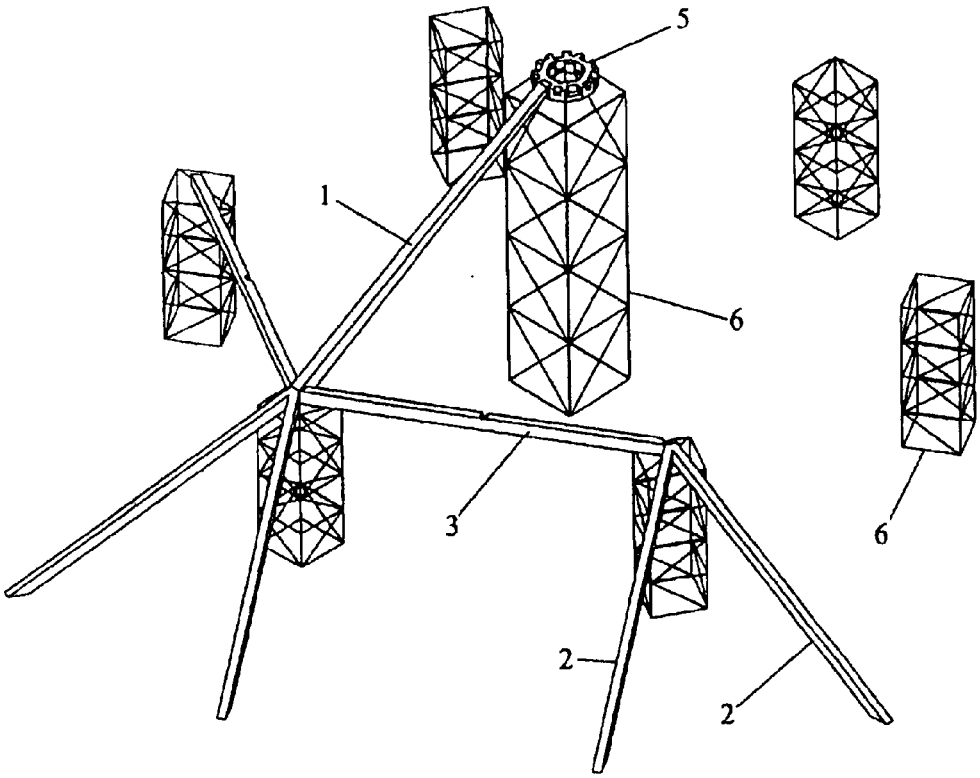
FIG. 2 shows a partially assembled space frame of the invention.

As shown in FIG. 2, these structures are assembled from solid or hollow section radial beams 1 and 2, which intersect and are jointed to one or more rings of circumferential beams 3 at node points 4. The upper ends of the radial beams 1 are jointed to a hub 5, which can be a solid disc as shown in FIG. 1*a* or can be an annular member with a central aperture as shown in FIG. 1*e* and FIG. 2.

Figure 3:
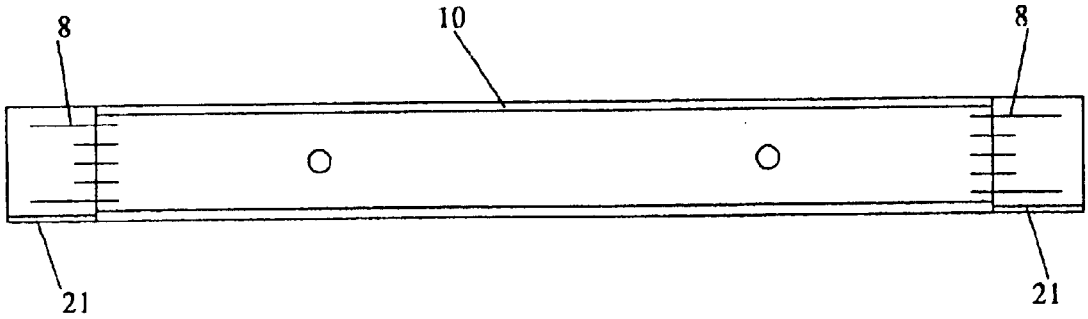
FIG. 3 is a longitudinal sectional view of a hollow beam suitable for use in the space frame structure of the invention.
Figure 4:
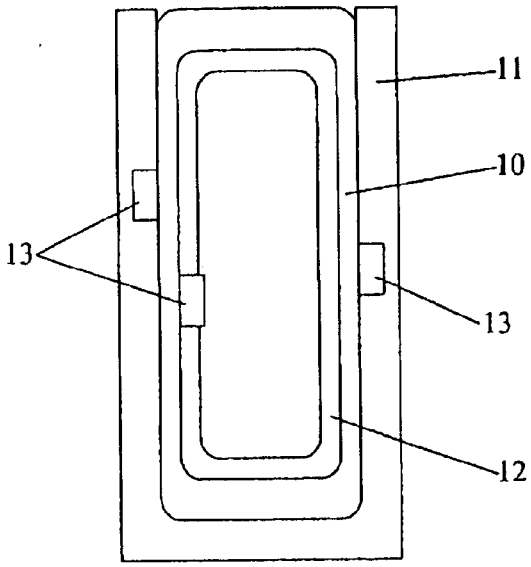
FIG. 4 is a transverse cross sectional view of the beam of FIG. 3 and the mould in which it is formed.

The structure is assembled by raising the hub 5 and beam members 1, 2, 3 into position using a crane or other lifting means and supporting them in the required position by means of scaffolding or other temporary support towers 6. The beam members converge at the node points 4 and a permanent rigid node joint (e.g., as designated by reference numeral 7 in FIG. 11) is formed at the node points. Preferably, reinforcing or other rods, plates or other linkage members 8 extend axially from the ends of the beams. These inter-engage or lap at the node points 4 and are incorporated into the ridge node joints 7 as described below to form a rigid structure. Once the joints 7 have been cured and the structure becomes self supporting, the temporary support towers 6 are progressively removed. As a result, the weight of the beam members 1, 2, 3 develops The beams are preferably cast on site at ground level using normal reinforced concrete casting techniques. A typical hollow beam 10 for present use is shown in FIGS. 3 and 4 and has axially extending metal bars or plates 8 at the ends thereof, for example the protruding ends of the reinforcing rods incorporated into the beams during casting. Such hollow beams can be cast within a mould 11 using an inner former 12 and vibrators 13, shown in FIG. 4, to form a box section beam using conventional casting techniques.

Figure 5:
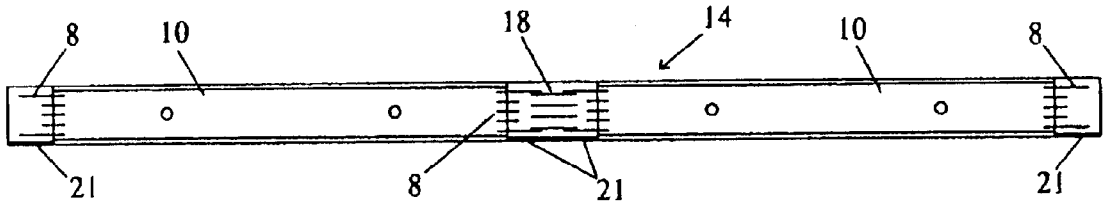
FIG. 5 is a longitudinal sectional view of a jointed hollow beam for use in the space frame structure of the invention.
Figure 6:
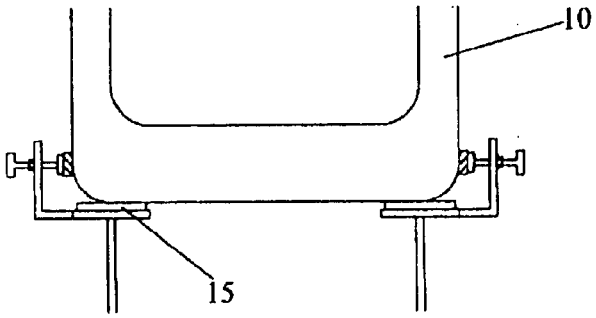
FIGS. 6 to 8 illustrate equipment used for aligning short beams sections during the fabrication of a jointed hollow beam of FIG. 5.
Figure 7:
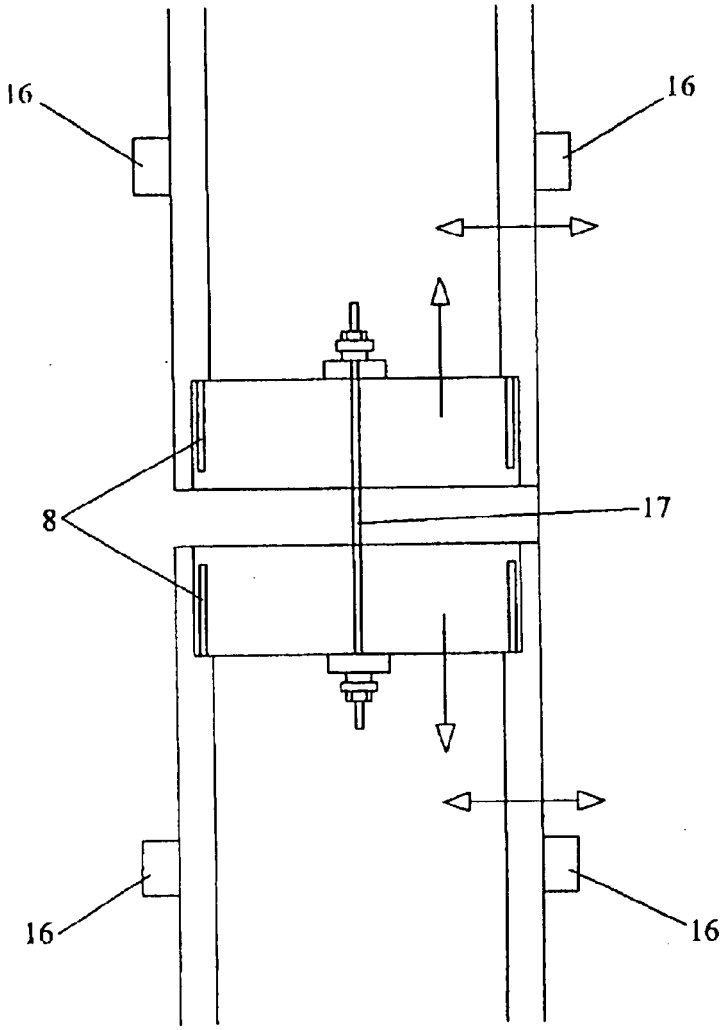
Figure 8:
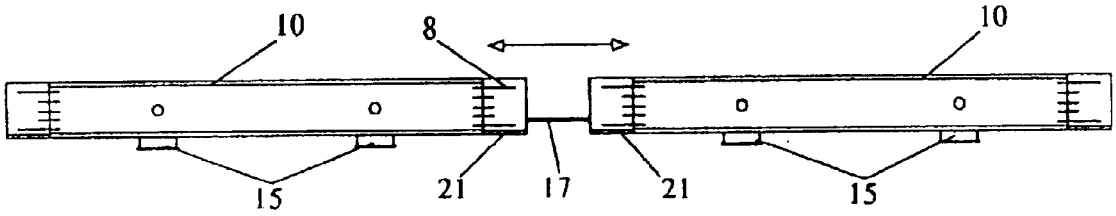
Figure 9:
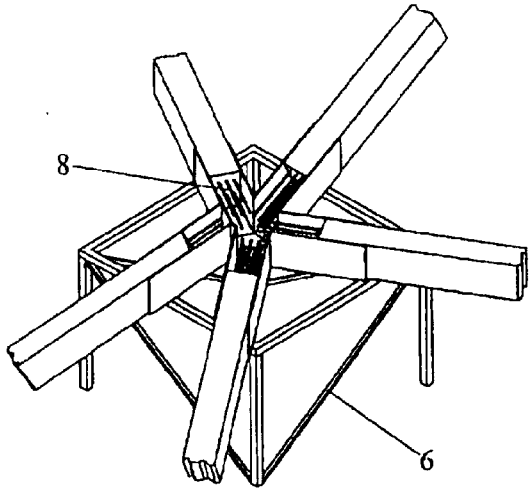
FIGS. 9 to 11 illustrate the formation of a rigid nodal joint in the space frame structure of FIG. 2.

In some cases, the beam may be shorter than required. Two such beams 10 can be jointed in end to end relationship to form a longer unitary beam 14 as shown in FIG. 5. This is preferably achieved using the equipment shown in FIGS. 6 to 8. For example, the two shorter sections of beam 10 can be placed on PTFE support pads 15 which have been accurately levelled up using shims or screw adjusters to align the sections 10 horizontally. The supports 15 are provided with screw operated sideways adjustment mechanisms 16 which can be adjusted to move each end of the section 10 independently sideways until the longitudinal axes of the beam sections 10 are coincident, the adjustments being monitored by a laser. The opposed ends of the sections 10 are provided with push/pull bolts 17 as shown in FIG. 7 so that the overall axial length of the unitary beam 14 can be adjusted to the desired value as shown in FIG. 8. The permanent joint between the opposing ends of the sections 10 can then be achieved by pouring concrete between the opposed ends to encase the rods 8 protruding from the opposing ends of the beams 10. If desired, a jointing spider 18 of axially extending rods or plates can be inserted between the rods 8 to reinforce the joint.

Figure 10:
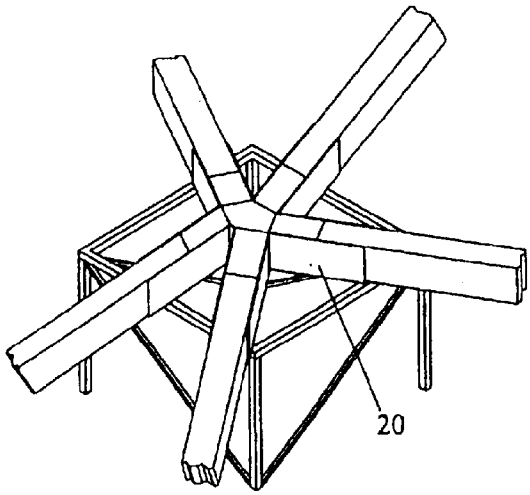
Figure 11:
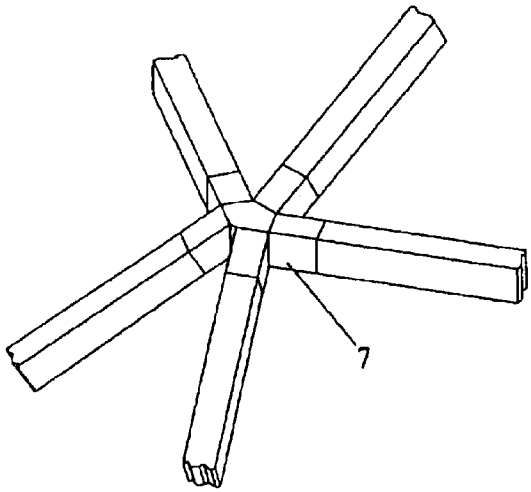
Figure 12:
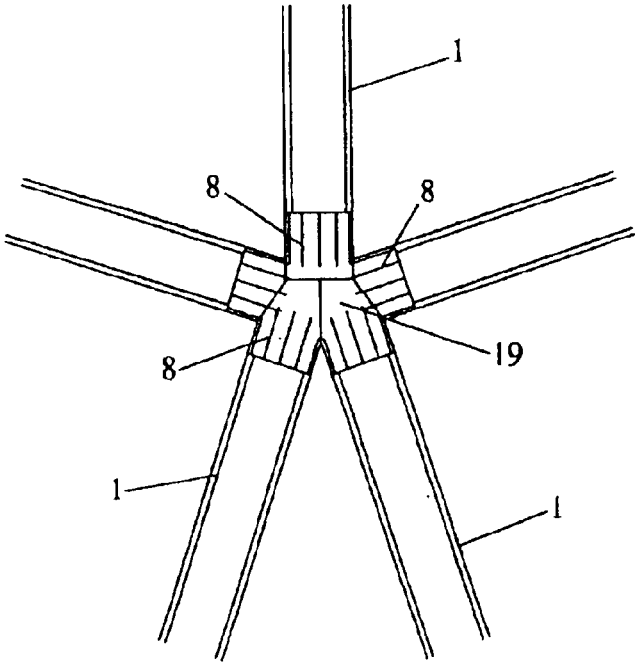
FIG. 12 is a horizontal sectional view of the nodal joint of FIG. 11.

The node joints 7 between the beams 1, 2 and 3 and between the beams 1 and the hub 5 can be formed in a similar manner. Typically, as shown in FIGS. 9 to 12, the rods 8 extending axially from the ends of the beams supported on towers 6 are intermeshed, optionally with an additional spider or pre-cast jointing piece as shown in FIG. 12. Shuttering 20, where this is not already provided by the jointing piece, is formed around the node point as shown in FIG. 10 and concrete poured to encase the node point, the rods and the jointing piece as shown in FIG. 11. If desired, further reinforcement, for example U bars and the like, can be incorporated into the joint.

Similarly, the inner ends of beams 2 engage in suitable slots or recesses 16 in the hub 5 and a permanent rigid joint is formed there.

If desired, a purpose built open topped shuttering box can be made from glass fibre reinforced polymer to the desired external shape of the node joint 7 and the ends of the beams 1, 2 and 3 laid into the open top channels in the shuttering box and the concrete poured into the box to form the in situ joint.

Figure 13:
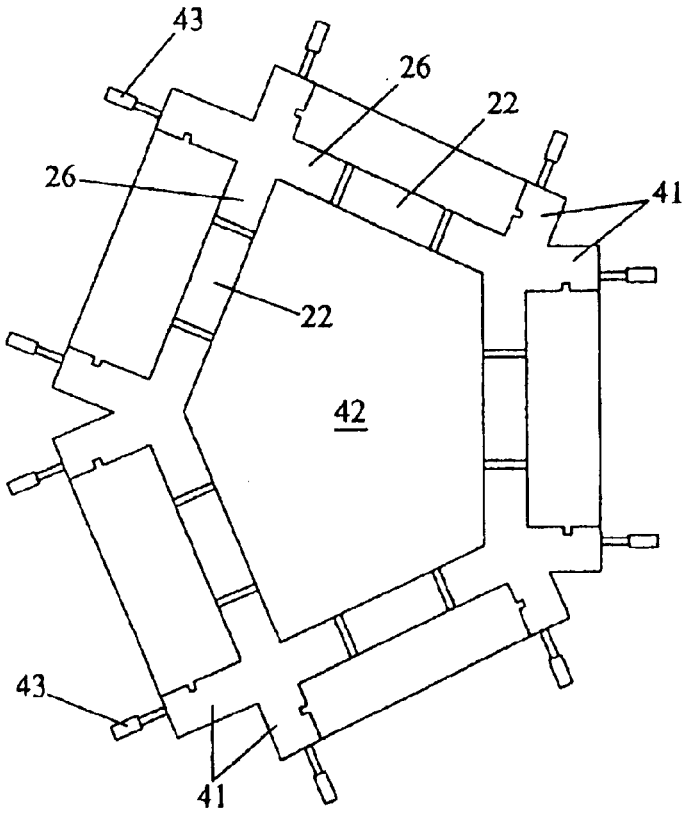
FIGS. 13 and 14 are horizontal sectional views through a pre-formed jointing piece for use in the nodal joint of FIG. 12.
Figure 14:
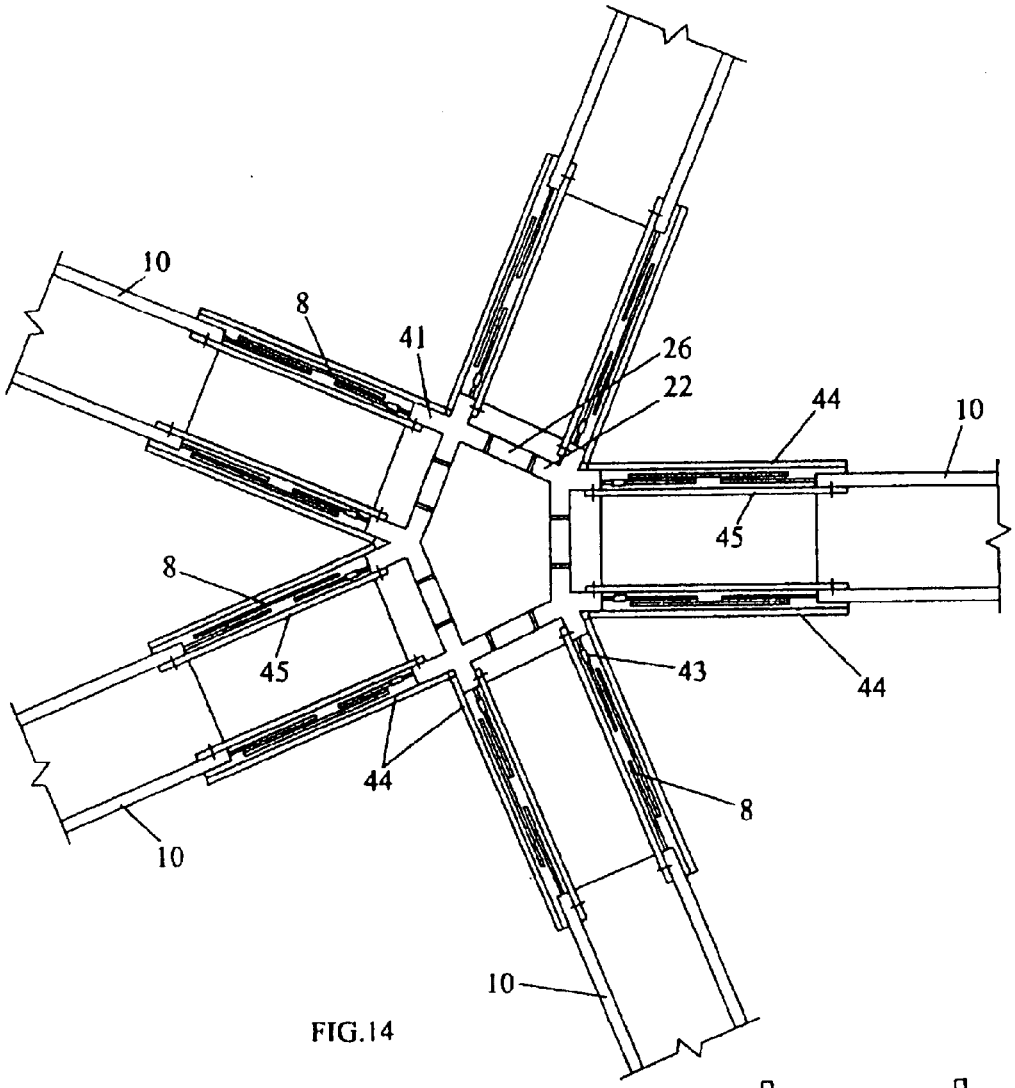

A form of pre-formed jointing piece 40 is shown in greater detail in FIGS. 13 and 14. The jointing piece comprises a pre-cast concrete node joint core 40 having radiating arms 41 which are to engage the ends of the radial and circumferential beams 1, 2, 3 either directly or via intermediate components to accommodate variations in the lengths of the beams and the geometry of the joint. The joint core also comprises a central nodal chamber 42 defined by the diaphragm walls 26 having the requisite duct or walkway 22 openings therein. The exposed ends of the arms 41 have protruding rods 43 or the like, for example the ends of reinforcing bars, which are to be imbedded in the concrete forming the permanent joint between the ends of the beams 10 and the jointing piece 40. It will usually be preferred that the rods 43 have screw ends which engage socket pieces in the ends of beams 10 to enable the jointing piece 40 to be drawn up firmly upon the beams 10. If desired, the jointing piece 10 can incorporate external and internal shuttering 44, 45 to retain the concrete in position around the jointed components whilst it sets and cures.

The resultant dome-like structure is a stable structure enclosing an internal open space without the need for internal pillars or other supports. Sheets of metal, plastic or other material can then be laid upon the framework and secured to the beams to provide a roofed enclosure.

Such a structure is simple and cost effective to build. However, the node joints 7 and the joints around the doughnut may be visible and aesthetically unattractive due to the prominence of the joints and the fact that the colour of the concrete cast in situ for the joints may be markedly different from that of the beams.

Figure 15:
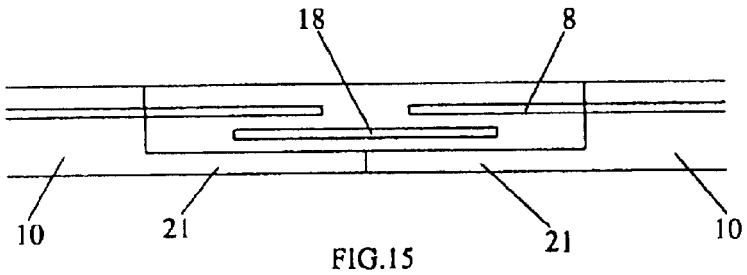
FIGS. 15 and 16 are sectional views through a modified nodal joint.
Figure 16:
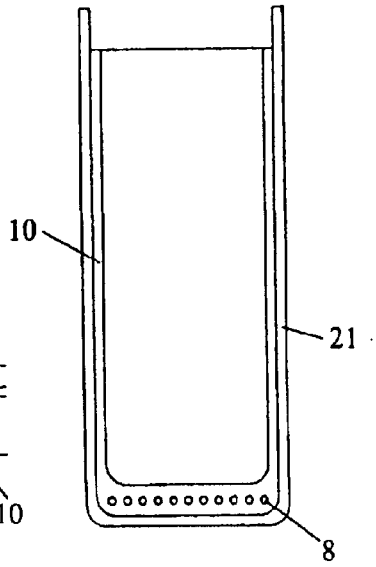

A structure having less obtrusive joints and utilising hollow beams can be fabricated using beams which have an axially extending shroud portion 21 as shown in FIGS. 3 and 5 and in detail in FIGS. 15 and 16. The shroud portion 21 extends axially as a thinner wall portion of the end of the wall of beam 10. Preferably, the shroud 21 does not extend for the full circumference of the beam 10, but forms an open topped portion as shown in FIG. 16 into which the concrete can be poured, a former or shuttering (not shown) being inserted into the interior of the beam to act as internal shuttering to retain the concrete in position whilst it sets. If desired, any small space between the opposing end faces of the shrouds 21 on opposed beams 10 can be grouted or filled with mastic. The open top of the joint can subsequently be closed by casting a slab over it using normal concrete casting techniques.

Figure 17:
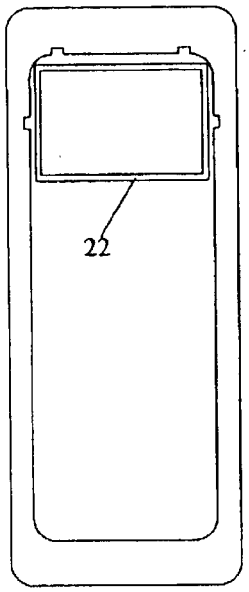
FIGS. 17 and 18 are transverse cross sectional views through a hollow beam showing the presence of service ducts and access openings in the beam.
Figure 18:
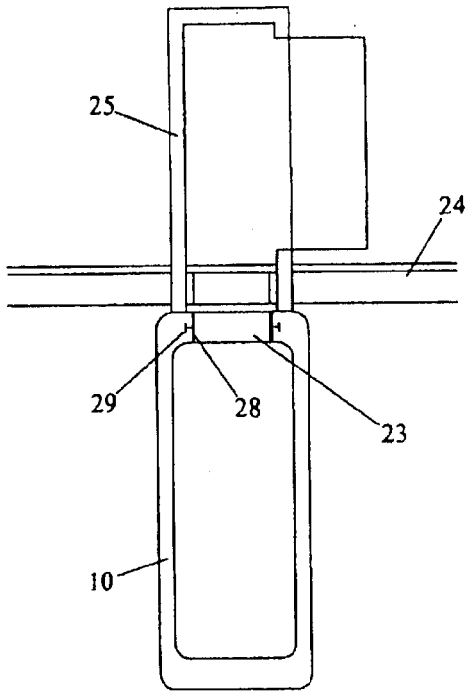

The use of hollow beam members 10 enables service ducting and walkways to be incorporated within the beam structure, thus avoiding the need to provide external access routes. For example, as shown in FIG. 17, the interior of the beam may be provided with a ventilation duct 22. As shown in FIG. 18, the wall of the beam can be provided with an access opening 23 whereby an operator can gain access to the exterior of the beam. In the case shown in FIG. 18, the access opening 23 is in the top wall of the beam 10 and provides access to the outer face of the sheet metal or other cladding 24 used to cover the space frame structure of the dome via an external cabin 25 and door.

Figure 19:
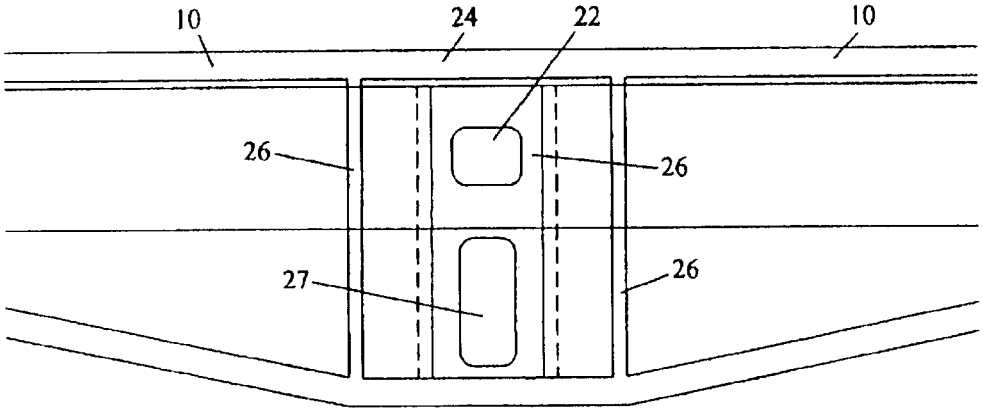
FIG. 19 is a cross sectional view through a nodal joint showing the presence of transverse walls at the end of the beams and openings in those walls.

It will usually be desired to provide the opposed ends of the beams 10 at the node joints 7 with transverse walls or diaphragms 26, as shown in FIG. 19. Such diaphragms serve to transmit forces from one component of the structure to another. Such diaphragms are preferably also provided with openings for service ducts 23 or walkways 27 as shown. Such diaphragms may be incorporated into a pre-formed jointing piece 40 as shown in FIGS. 13 and 14 rather than at the ends of the beams 10.

Figure 20:
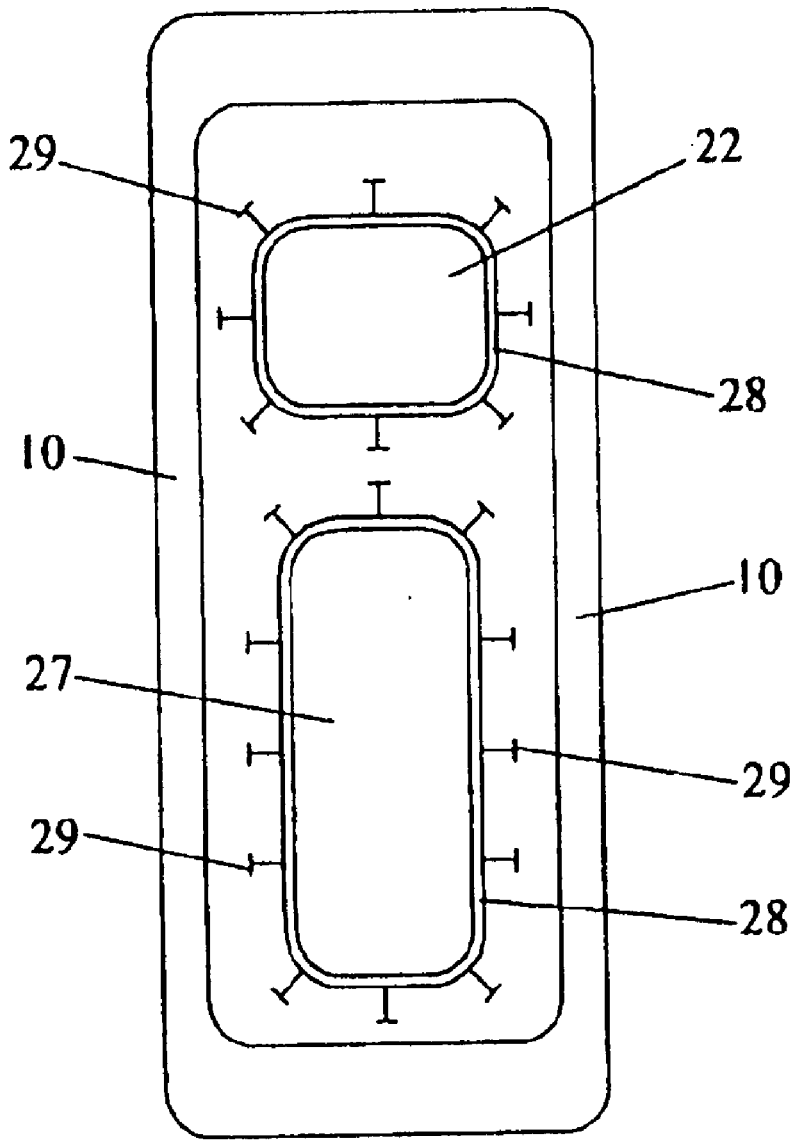
FIG. 20 illustrates details of the linings for openings in the wall of a beam.
Figure 21:
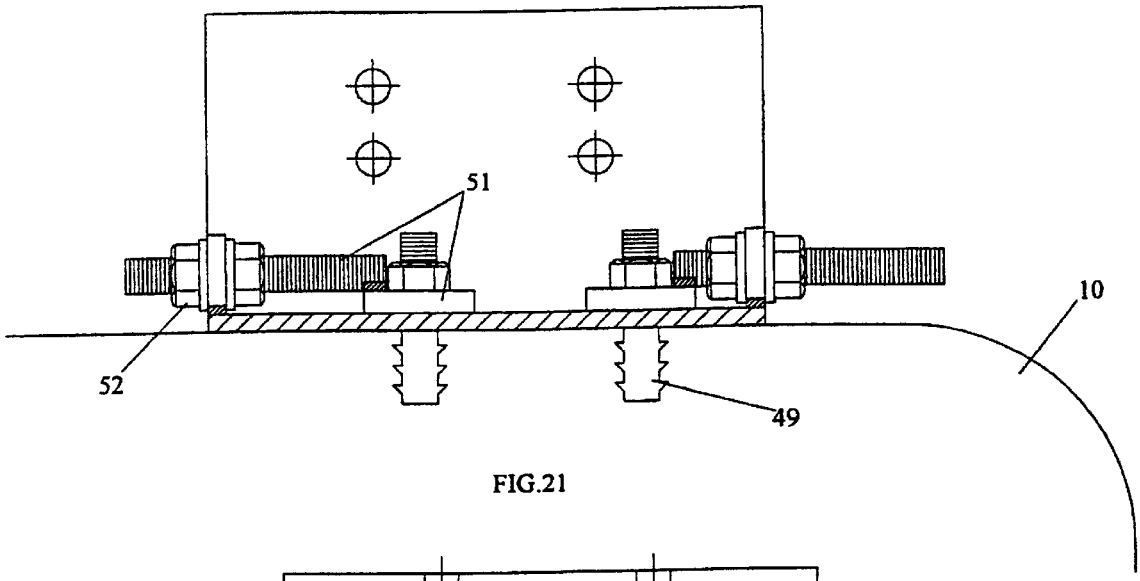
FIGS. 21 to 23 illustrate an adjustable bracket for securing a secondary beam to a main beam.
Figure 22:
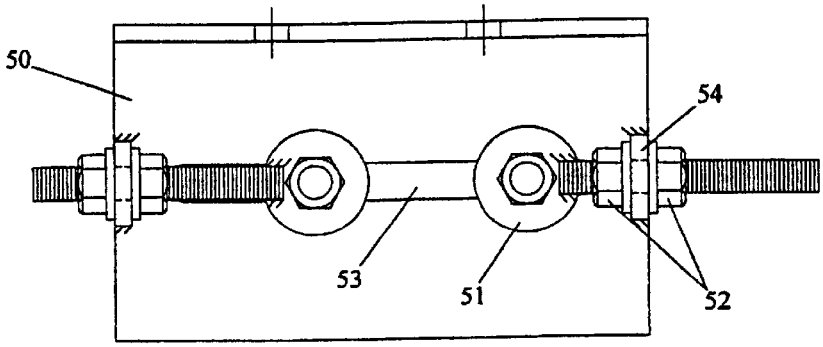
Figure 23:
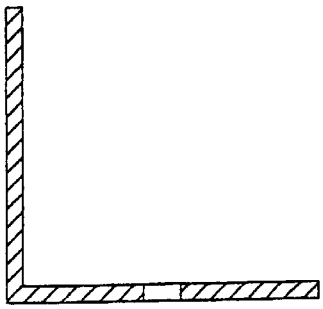

Since the walls of the beams 10 are under stress, it will usually be desired to provide any openings formed in the walls of the beams with steel or other substantial linings 28 as shown in FIG. 20 and to round any corners in such openings. The linings 28 are secured in place by means of studs 29 set into the concrete of the diaphragm 26 or the wall of the beam 10 and welded to the lining 28 as shown. Z purlins or other secondary beams can be attached to the concrete framework formed by the main radial and circumferential beams by the adjustable mounting brackets 50 shown in FIGS. 21 to 23. This is in the form of an L section plate. One arm of the L has an axial slot 53 which engages threaded stud bolts 49 protruding transversely from the main concrete beam. The bracket 50 carries two opposed eye bolts 51 extending axially in register with the slot 53 and whose axial position with respect to the slot 53 can be adjusted by suitable nuts 52 engaging the threads of the eye bolts 51. The eyes of the eyebolts 51 are secured to the bolts 49 by nuts on the bolts 49. The other arm of the L of the bracket is to receive the end of a purlin beam and to be secured thereto by bolts or other means. The position of the bracket 50 upon the main beam is adjusted by altering the position of the eyebolts 51 relative to the slot so that the bracket moves axially with respect to the stud bolts 49 to bring other holes in the bracket into register with bolts in the end of the purlin beam without the need to adapt the purlin beam. The bracket 50 is then locked in the desired position by drawing the eyebolts axially outward in opposite directions along slot 53 by means of nuts 52.

What is claimed is:

1. A method for constructing a large, open-span frame structure, comprising the steps of:

lifting a first plurality of pre-cast concrete beam members into radially-extending positions and temporarily supporting said pre-cast concrete beam members in said radially-extending positions;

lifting a second plurality of pre-cast concrete beam members into circumferentially-extending positions spanning adjacent said pre-cast concrete beam members in said radially-extending positions and temporarily supporting said pre-cast concrete beam members in said circumferentially-extending positions; and, forming rigid node joints between each said pre-cast concrete beam member in said circumferentially-extending position and said pre-cast concrete beam members in radially-extending positions which said pre-cast concrete member in circumferentially-extending position spans, with an included angle between each said pre-cast concrete beam member in said circumferentially-extending position at each said rigid node joint being from 90° to 160°.

2. The method for constructing a large, open-span frame structure according to claim 1, wherein said rigid node joints are formed by casting concrete join in situ.

3. The method for constructing a large, open-span frame structure according to claim 2, wherein said rigid node joints incorporate mechanical joints around which said concrete joints are cast.

4. The method for constructing a large, open-span frame structure according to claim 1, wherein there are from 4 to 14 said pre-cast concrete beam members in said radially-extending positions radiating from a central hub or apex said large, open-span structure.

5. The method for constructing a large, open-span frame structure according to claim 1, wherein at least some of said pre-cast concrete beam members are hollow.

6. The method for constructing a large, open-span frame structure according to claim 5, wherein said pre-cast beam member which are hollow incorporate transverse internal walls at, or adjacent to, the ends thereof.

7. A method for constructing a large, open-span frame structure, comprising the steps of:

lifting a first plurality of pre-cast concrete beam members into radially-extending positions and temporarily supporting said pre-cast concrete beam members in said radially-extending positions;

lifting a second plurality of pre-cast concrete beam members into circumferentially-extending positions spanning adjacent said pre-cast concrete beam members in said radially-extending positions and temporarily supporting said pre-cast concrete beam members in said circumferentially-extending positions; and, forming rigid node joints between each said pre-cast concrete beam member in said circumferentially-extending position and said pre-cast concrete beam members in radially-extending positions which said pre-cast concrete beam member in circumferentially-extending position spans, with said pre-cast concrete beam members in said radially-extending positions subtending an angle of from 10° to 30° to the horizontal at least at a radially-outer periphery of said large, open-span structure.

8. The method for constructing a large, open-span frame structure according to claim 7, wherein said rigid node joints are formed by casting concrete join in situ.

9. The method for constructing a large, open-span frame structure according to claim 8, wherein said rigid node joints incorporate mechanical joints around which said concrete joints are cast.

10. The method for constructing a large, open-span frame structure according to claim 7, wherein there are from 4 to 14 said pre-cast concrete beam members in said radially-extending positions radiating from a central hub or apex said large, open-span structure.

11. The method for constructing a large, open-span frame structure according to claim 7, wherein at least some of said pre-cast concrete beam members are hollow.

12. The method for constructing a large, open-span frame structure according to claim 11, wherein said pre-cast beam member which are hollow incorporate transverse internal walls at, or adjacent to, the ends thereof.

13. A method for constructing a large, open-span frame structure, comprising the steps of:

lifting a first plurality of pre-cast concrete beam members into radially-extending positions and temporarily supporting said pre-cast concrete beam members in said radially-extending positions;

lifting a second plurality of pre-cast concrete beam members into circumferentially-extending positions spanning adjacent said pre-cast concrete beam members in said radially-extending positions and temporarily supporting said pre-cast concrete beam members in said circumferentially-extending positions; and, forming rigid node joints between each said pre-cast concrete beam member in said circumferentially-extending position and said pre-cast concrete beam members in radially-extending positions which said pre-cast concrete beam member in circumferentially-extending position spans, with at least some of said pre-cast concrete beam members comprising shorter beams which have been joined end-to-end by rigid joints for forming a unitary longer beam member.

14. The method for constructing a large, open-span frame structure according to claim 13, wherein said rigid node joints are formed by casting concrete join in situ.

15. The method for constructing a large, open-span frame structure according to claim 14, wherein said rigid node joints incorporate mechanical joints around which said concrete joints are cast.

16. The method for constructing a large, open-span frame structure according to claim 13, wherein there are from 4 to 14 said pre-cast concrete beam members in said radially-extending positions radiating from a central hub or apex said large, open-span structure.

17. The method for constructing a large, open-span frame structure according to claim 13, wherein at least some of said pre-cast concrete beam members are hollow.

18. The method for constructing a large, open-span frame structure according to Claim wherein said pre-cast beam member which are hollow incorporate transverse internal walls at, or adjacent to, the ends thereof.

19. A method for constructing a large, open-span frame structure, comprising the steps of:

lifting a first plurality of pre-cast concrete beam members into radially-extending positions and temporarily supporting said pre-cast concrete beam members in said radially-extending positions;

lifting a second plurality of pre-cast concrete beam members into circumferentially-extending positions spanning adjacent said pre-cast concrete beam members in said radially-extending positions and temporarily supporting said pre-cast concrete beam members in said circumferentially-extending positions;

forming rigid node joints between each said pre-cast concrete beam member in said circumferentially-extending position and said pre-cast concrete beam members in radially-extending positions which said pre-cast concrete beam member in circumferentially-extending position spans; and, providing secondary beam members between a main pre-cast concrete beam member in radially-extending position and a main pre-cast concrete beam member in circumferentially-extending position.

20. The method for constructing a large, open-span frame structure according to claim 19, wherein said secondary beam members are connected to said main pre-cast concrete beam member in radially-extending position and said main pre-cast concrete beam member in circumferentially-extending position via adjustable mounting means.

21. The method for constructing a large, open-span frame structure according to claim 19, wherein said rigid node joints are formed by casting concrete join in situ.

22. The method for constructing a large, open-span frame structure according to claim 21, wherein said rigid node joints incorporate mechanical joints around which said concrete joints are cast.

23. The method for constructing a large, open-span frame structure according to claim 21, wherein there are from 4 to 14 said pre-cast concrete beam members in said radially-extending positions radiating from a central hub or apex said large, open-span structure.

24. The method for constructing a large, open-span frame structure according to claim 21, wherein at least some of said pre-cast concrete beam members are hollow.

25. The method for constructing a large, open-span frame structure according to claim 24, wherein said pre-cast beam member which are hollow incorporate transverse internal walls at, or adjacent to, the ends thereof.

26. A method for constructing a large, open-span frame structure, comprising the steps of:

lifting a first plurality of pre-cast concrete beam members into radially-extending positions and temporarily supporting said pre-cast concrete beam members in said radially, extending positions;

lifting a second plurality of pre-cast concrete beam members into circumferentially-extending positions spanning adjacent said pre-cast concrete beam members in said radially-extending positions and temporarily supporting said pre-cast concrete beam members in said circumferentially-extending positions; and, forming rigid node joints between each said pre-cast concrete beam member in said circumferentially-extending position and said pre-cast concrete beam members in radially-extending positions which said pre-cast concrete member in circumferentially-extending position spans, said rigid node joints incorporating pre-formed jointing pieces rigidly jointed to said pre-cast concrete beam members in said circumferentially-extending position and said pre-cast concrete beam members in radially-extending positions.

27. The method for constructing a large, open-span frame structure according to claim 26, wherein said rigid node joints are formed by casting concrete join in situ.

28. The method for constructing a large, open-span frame structure according to claim 27, wherein said rigid node joints incorporate mechanical joints around which sail concrete joints are cast.

29. The method for constructing a large, open-span frame structure according to claim 26, wherein there are from 4 to 14 said pre-cast concrete beam-members in said radially-extending positions radiating from a central hub or apex said large, open-span structure.

30. The method for constructing a large, open-span frame structure according to claim 26, wherein at least some of said pre-cast concrete beam members are hollow.

31. The method for constructing a large, open-span frame structure according to claim 30, wherein said pre-cast beam member which are hollow incorporate transverse internal walls at, or adjacent to, the ends thereof.

32. A method for constructing a large, open-span frame structure, comprising the steps of:

lifting a first plurality of pre-cast concrete beam members into radially-extending positions and temporarily supporting said pre-cast concrete beam members in said radially-extending positions;

lifting a second plurality of pre-cast concrete beam members into circumferentially-extending positions spanning adjacent said pre-cast concrete beam members in said radially-extending positions and temporarily supporting said pre-cast concrete beam members in said circumferentially-extending positions;

providing a hollow beam member having a wall, said wall having an opening with said opening having rounded corners and provided with a substantial lining thereto, which is secured to a material of said wall; and, forming rigid node joints between each said pre-cast concrete beam member in said circumferentially-extending position and said pre-cast concrete beam members in radially-extending positions which said pre-cast concrete member in circumferentially-extending position spans.

33. The method for constructing a large, open-span frame structure according to claim 32, wherein said rigid node joints are formed by casting concrete join in situ.

34. The method for constructing a large, open-span frame structure according to claim 33, wherein said rigid node joints incorporate mechanical joints around which said concrete joints are cast.

35. The method for constructing a large, open-span frame structure according to claim 32, wherein there are from 4 to 14 said pre-cast concrete beam members in said radially-extending positions radiating from a central hub or apex said large, open-span structure.

* * * * *